US007999767B2

(12) United States Patent
Jung et al.

(10) Patent No.: US 7,999,767 B2
(45) Date of Patent: Aug. 16, 2011

(54) METHOD AND APPARATUS FOR DRIVING PLASMA DISPLAY PANEL

(75) Inventors: Yun Kwon Jung, Kumi-shi (KR); Jin Young Kim, Daegu-kwangyeokshi (KR)

(73) Assignee: LG Electronics Inc., Seoul (KR)

( * ) Notice: Subject to any disclaimer, the term of this patent is extended or adjusted under 35 U.S.C. 154(b) by 928 days.

(21) Appl. No.: 11/945,478

(22) Filed: Nov. 27, 2007

(65) Prior Publication Data

US 2008/0150927 A1 Jun. 26, 2008

Related U.S. Application Data

(63) Continuation of application No. 10/834,868, filed on Apr. 30, 2004, now Pat. No. 7,321,346.

(30) Foreign Application Priority Data

May 2, 2003 (KR) ..... 10-2003-0028291

(51) Int. Cl.
*G09G 3/28* (2006.01)
*H01J 17/49* (2006.01)

(52) U.S. Cl. ..... 345/68; 345/60; 345/204; 345/690

(58) Field of Classification Search ..... 313/231.31, 313/484, 491, 585, 604, 622; 315/111.91, 315/169.1, 169.4; 345/55, 60, 68, 204, 690, 345/691, 694
See application file for complete search history.

(56) References Cited

U.S. PATENT DOCUMENTS

| | | | | |
|---|---|---|---|---|
| 6,034,482 | A | 3/2000 | Kanazawa et al. | |
| 6,670,774 | B2 | 12/2003 | Son et al. | |
| 6,696,794 | B2 | 2/2004 | Ishizuka | |
| 6,836,262 | B2 | 12/2004 | Nagai et al. | |
| 7,148,863 | B2 | 12/2006 | Lee et al. | |
| 7,164,395 | B2 | 1/2007 | Myoung et al. | |
| 7,321,346 | B2 * | 1/2008 | Jung et al. | 345/68 |
| 7,471,266 | B2 * | 12/2008 | Jung et al. | 345/68 |
| 2003/0222835 | A1 | 12/2003 | Yoon et al. | |
| 2004/0145542 | A1 | 7/2004 | Kim | |
| 2004/0212560 | A1 | 10/2004 | Son et al. | |
| 2007/0069985 | A1 | 3/2007 | Lee et al. | |

FOREIGN PATENT DOCUMENTS

KR 2003-0029718 4/2003

* cited by examiner

*Primary Examiner* — My-Chau T Tran
(74) *Attorney, Agent, or Firm* — KED & Associates LLP

(57) ABSTRACT

There is disclosed a method and apparatus of driving a plasma display panel that is adaptive for improving its contrast and enabling its high speed driving. A driving method of a plasma display panel according to an embodiment of the present invention applies a setup voltage with a first gradient to the scan electrode for the reset period; and applies the setup voltage with a second gradient to the sustain electrode while a voltage on the scan electrode rises.

25 Claims, 13 Drawing Sheets

METHOD AND APPARATUS FOR DRIVING PLASMA DISPLAY PANEL

This application is a continuation application of U.S. application Ser. No. 10/834,868, filed on Apr. 30, 2004 now U.S. Pat. No. 7,321,346, which claims the benefit of Korean Patent Application No. P2003-28291 filed on May 2, 2003, which is hereby incorporated by reference.

BACKGROUND OF THE INVENTION

1. Field of the Invention

The present invention relates to a plasma display panel, and more particularly to a method and apparatus of driving a plasma display panel that is adaptive for improving its contrast and enabling its high speed driving.

2. Description of the Related Art

A plasma display panel (hereinafter 'PDP') excites a phosphorus by using ultraviolet ray to emit light, thereby displaying a picture, wherein the ultraviolet ray is generated when inert mixture gas such as He+Xe, Ne+Xe and He+Xe+Ne is discharged. The PDP has its picture quality improved in debt to recent technology development as well as being easy to be made thin in thickness and big in size.

Referring to FIG. 1, a discharge cell of a three electrode AC surface discharge PDP of prior art includes scan electrodes Y1 to Yn, a sustain electrode Z, and address electrodes X1 to Xm crossing the scan electrodes Y1 to Yn and the sustain electrode Z perpendicularly.

A cell 1 is formed at each of the intersections of the scan electrodes Y1 to Y, the sustain electrode Z and the address electrodes X1 to Xm. The scan electrode Y1 to Yn and the sustain electrode Z are formed on an upper substrate (not shown). A dielectric layer and an MgO passivation layer is deposited on the upper substrate. The address electrodes X1 to Xm are formed on a lower substrate (not shown). Barrier ribs are formed on the lower substrate to prevent optical and electrical crosstalk from occurring between the cells that are horizontally adjacent to one another. A phosphorus layer is formed on the surface of the lower substrate and the barrier ribs, wherein the phosphorus is excited by vacuum ultraviolet to emit visible light. Inert mixture gas such as He+Xe, Ne+Xe and He+Xe+Ne is injected into a discharge space provided between the upper/lower substrates.

In order to realize the gray level of a picture, the PDP is time-dividedly driven by dividing one frame into several sub-fields that have the number of their light emission different from one another. Each sub field can be divided into a reset period to initialize a full screen, an address period to select scan lines and select cells from the selected scan lines, and a sustain period to realize gray levels in accordance with the number of discharge. For example, in the event of displaying a picture with 256 gray levels, the frame period (16.67 ms) corresponding to 1/60 second as in FIG. 2 is divided into 8 sub-fields (SF1 to SF8). Each of the 8 sub-fields (SF1 to SF8), as described above, is divided into the reset period, the address period and the sustain period. The reset period and the address period of each sub-field are the same for each sub-field, while the sustain period and the number of sustain pulses allotted thereto increase at the rate of $2^n$ (n=0, 1, 2, 3, 4, 5, 6, 7) in each sub-field.

FIG. 3 illustrates a driving waveform of a PDP which is applied to two sub-fields.

Referring to FIG. 3, the PDP is driven in the manner of dividing one frame into a reset period to initialize a full screen, an address period to select cells and a sustain period to sustain the discharge of the selected cells.

In the beginning of the reset period, a rising ramp waveform Ramp-up is applied to all scan electrodes Y, and 0V is applied to the sustain electrode Z and the address electrode X. The rising ramp waveform Ramp-up causes a write dark discharge or a setup discharge to occur between the scan electrode Y and the address electrode X and the scan electrode Y and the sustain electrode Z within the cells of the full screen, wherein almost no light is generated in the write dark discharge. The setup discharge causes positive wall charges to be accumulated in the address electrode X and the sustain electrode Z, and negative wall charges to be accumulated in the scan electrode Y.

In the end of the reset period, a falling ramp waveform Ramp-down is simultaneously applied to the scan electrodes Y, wherein the falling ramp waveform Ramp-down declines from around sustain voltage Vs. At the same time, sustain voltage Vs of positive polarity is applied to the sustain electrode Z, and 0V is applied to the address electrode X. When the falling ramp waveform Ramp-down is applied in this way, a erasure dark discharge or a set-down discharge is generated between the scan electrode Y and the sustain electrode Z, wherein almost no light is generated in the erasure dark discharge. The set-down discharge eliminates the excessive wall charges that are unnecessary for the address discharge.

In the address period, negative scan pulses SCAN are sequentially applied to the scan electrodes Y and at the same time positive data pulses DATA synchronized with the scan pulses SCAN are applied to the address electrodes X. When the voltage difference between the scan pulse SCAN and the data pulse DATA is added to the wall voltages generated in the reset period, the address discharge is generated within the cell to which the data pulse DATA is applied. When sustain voltages are applied, wall charges to the extent that the discharge might be generated are formed within the cells selected by the address discharge.

Positive DC voltage Zdc is applied to the sustain electrode Z for the set-down period and the address period so as not to generated a mis-discharge between the scan electrode Y and the sustain electrode Z.

In the sustain period, sustain pulses SUS are alternately applied to the scan electrodes Y and the sustain electrodes Z. In the cells selected by the address discharge, a sustain discharge, i.e., display discharge, is generated between the scan electrode Y and the sustain electrode Z whenever each sustain pulse SUS is applied as the wall voltage within the cell is added to the sustain pulse SUS.

Recently, the content of Xe tends to be increased in order to enhance discharge efficiency in the sealed discharge gas of the PDP. But, there is a problem that jitter value is heightened if the content of Xe is increased, wherein the jitter value represents the extent that discharge is delayed. If the discharge is delayed in this way, the discharge is generated in a big scale beyond the extent of a desired discharge level, so that it becomes difficult to control wall charges and the black brightness of the reset period heightens, thereby deteriorating its contrast characteristic. It will be explained in detail in conjunction with FIGS. 4 and 5.

In the PDP where the content of Xe is low, an applied voltage Vyz and a gap voltage Vg are supplied for the reset period, as shown in FIG. 4. The applied voltage is a voltage between the scan electrode Y and the sustain electrode Z, which is applied to the scan electrode Y and the sustain electrode Z from an external driving circuit, as shown in FIG. 3. The gap voltage Vg is a voltage applied to the discharge gas and the gap voltage Vg causes discharge to be generated within the cell.

If the content of Xe is low, the setup discharge of the reset period is generated when the gap voltage Vg reaches a firing voltage Vf. After the setup discharge is generated, the gap voltage Vg remains at the firing voltage Vf until the ramp waveform Ramp-dn of descending tilt is applied to the scan electrode Y. In the same manner, the set-down discharge of the reset period is generated when the gap voltage Vg reaches a firing voltage −Vf. After the set-down discharge is generated, the gap voltage Vg remains at the firing voltage −Vf until a scan bias voltage is applied to the scan electrode Y. On the other hand, in an initial state 41 before the reset period starts, the wall voltage Vg might be different by cells because the number of sustain discharges and so on are different by cells.

If the content of Xe is high, as shown in FIG. 5, the setup discharge is not generated at the point of time tf when the gap voltage Vg reaches the firing voltage Vf but is generated at the point of time tf' that is delayed by a jitter value from the point of time tf because of the discharge delay caused by the high content of Xe. At the point of time tf', the wall voltage Vf increases to a voltage higher than the firing voltage Vf as the external applied voltage Vyz increases. Accordingly, the setup discharge is generated in a big scale beyond the extent of a desired discharge level. Likewise, if the content of Xe is high, the set-down discharge is generated in a big scale.

Also, the PDP of prior art has the data pulse and the scan pulse wide in their pulse width because the PDP has the delay of address discharge relatively longer. Because of this, the PDP of prior art has a longer address period within the limited one frame period, thus there arises a problem that the sufficient sustain period cannot be secured when adding sub-fields to increase the resolution of the PDP or to improve picture quality.

SUMMARY OF THE INVENTION

Accordingly, it is an object of the present invention to provide a method and apparatus of driving a plasma display panel that is adaptive for improving its contrast and enabling its high speed driving.

In order to achieve these and other objects of the invention, a driving method of a plasma display panel having an address electrode, a scan electrode and a sustain electrode wherein one frame is divided into a reset period, an address period and a sustain period according to an aspect of the present invention includes the steps of: applying a setup voltage with a first gradient to the scan electrode for the reset period; and applying the setup voltage with a second gradient to the sustain electrode while a voltage on the scan electrode rises.

In the driving method, the first gradient is lower than the second gradient.

In the driving method, a beginning point of time of the setup voltage applied to the scan electrode is different from a beginning point of time of the setup voltage applied to the sustain electrode.

In the driving method, the beginning point of time of the setup voltage applied to the scan electrode is faster than the beginning point of time of the setup voltage applied to the sustain electrode.

The driving method further includes the step of: simultaneously applying a set-down voltage with a third gradient to the scan electrode and a different voltage from the set-down voltage with a fourth gradient to the sustain electrode after applying the setup voltage to the scan electrode and the sustain electrode.

In the driving method, the third gradient is higher than the fourth gradient.

In the driving method, the set-down voltage is a designated negative voltage.

In the driving method, the sustain electrode goes down to a ground voltage GND or 0V.

The driving method further includes the step of: keeping the address electrode at a ground voltage GND or 0V for the reset period.

In the driving method, the step of applying the setup voltage to the sustain electrode is that the setup voltage is applied to the sustain electrode by a ramp waveform rising from a specific voltage of positive polarity.

In the driving method, the specific voltage of positive polarity is a sustain voltage.

In the driving method, the step of applying the setup voltage to the sustain electrode is that the setup voltage is applied to the sustain electrode by a ramp waveform rising from a ground voltage GND or 0V.

A driving method of a plasma display panel having an address electrode, a scan electrode and a sustain electrode wherein one frame is divided into a reset period, an address period and a sustain period, according to another aspect of the present invention includes the step of: continuously applying a setup voltage at least twice to the scan electrode for the reset period; and applying the setup voltage to the sustain electrode within a period that the setup voltage is applied to the scan electrode.

In the driving method, the step of applying the setup voltage to the scan electrode includes the step of: applying a second rising ramp waveform to the scan electrode after applying a first rising ramp waveform to the scan electrode.

In the driving method, the step of applying the setup voltage to the sustain electrode includes the step of: applying a third ramp waveform synchronized with the second rising ramp waveform to the sustain electrode.

The driving method further includes the step of: simultaneously applying a set-down voltage to the scan electrode and a different voltage from the set-down voltage to the sustain electrode after applying the setup voltage to the scan electrode and the sustain electrode.

In a driving method of a plasma display panel having a plurality of cells formed wherein one frame is divided into a reset period, an address period and a sustain period, according to still another aspect of the present invention, the reset period includes: a first setup period during which a first setup discharge is generated in the cells; a second setup period during which a second setup discharge is generated in the cells; and a set-down period during which a set-down discharge is generated in the cells.

A driving apparatus of a plasma display panel having an address electrode, a scan electrode and a sustain electrode wherein one frame is divided into a reset period, an address period and a sustain period, according to still another aspect of the present invention includes a first setup circuit to apply a setup voltage with a first gradient to the scan electrode for the reset period; and a second setup circuit to apply the setup voltage with a second gradient to the sustain electrode while a voltage on the scan electrode rises.

The first gradient is lower than the second gradient.

A beginning point of time of the setup voltage applied to the scan electrode is different from a beginning point of time of the setup voltage applied to the sustain electrode.

The beginning point of time of the setup voltage applied to the scan electrode is faster than the beginning point of time of the setup voltage applied to the sustain electrode.

The driving apparatus further includes a set-down circuit to simultaneously apply a set-down voltage with a third gradient to the scan electrode and a different voltage from the set-down voltage with a fourth gradient to the sustain electrode after applying the setup voltage to the scan electrode and the sustain electrode.

The driving apparatus further includes an address electrode driving circuit to keep the address electrode at 0V for the reset period.

The second setup circuit applies a ramp waveform rising from a specific voltage of positive polarity to the sustain electrode.

The specific voltage of positive polarity is a sustain voltage.

The second setup circuit applies a ramp waveform rising from a ground voltage GND or 0V to the sustain electrode.

A driving apparatus of a plasma display panel having an address electrode, a scan electrode and a sustain electrode wherein one frame is divided into a reset period, an address period and a sustain period, according to still another aspect of the present invention includes a first setup circuit to continuously apply a setup voltage at least twice to the scan electrode for the reset period; and a second setup circuit to apply the setup voltage to the sustain electrode within a period that the setup voltage is applied to the scan electrode.

The first setup circuit applies a second rising ramp waveform to the scan electrode after applying a first rising ramp waveform to the scan electrode.

The second setup circuit applies a third ramp waveform synchronized with the second rising ramp waveform to the sustain electrode.

The driving apparatus further includes a set-down circuit to simultaneously apply a set-down voltage to the scan electrode and a different voltage from the set-down voltage to the sustain electrode after applying the setup voltage to the scan electrode and the sustain electrode.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

With reference to FIGS. 6 to 13, embodiments of the present invention will be explained as follows.

Figure 1:
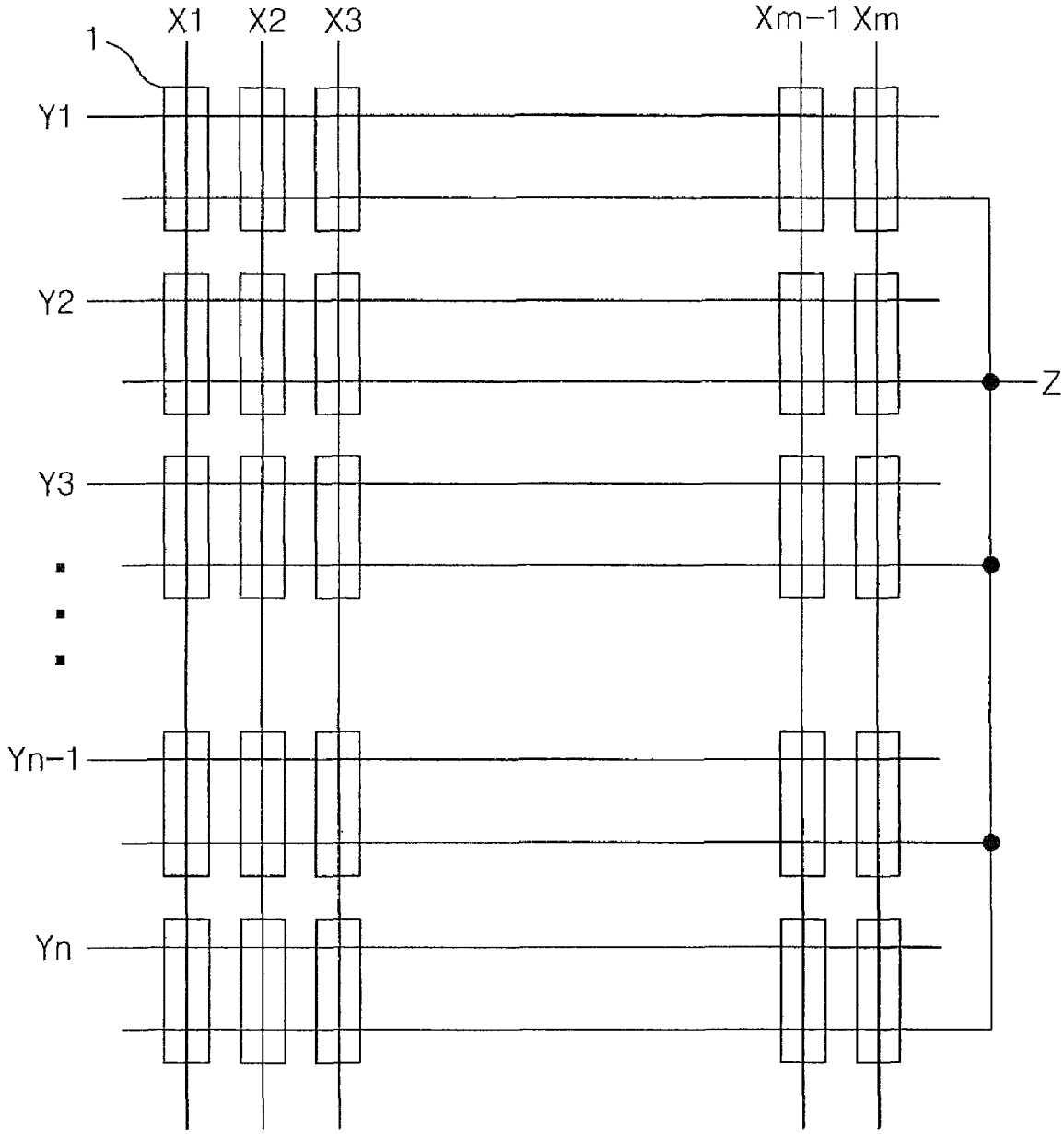
FIG.1 RELATED ART
FIG. 1 is a plan view representing the electrode arrangement of a 3-electrode AC surface discharge plasma display panel of prior art in brief.
Figure 2:
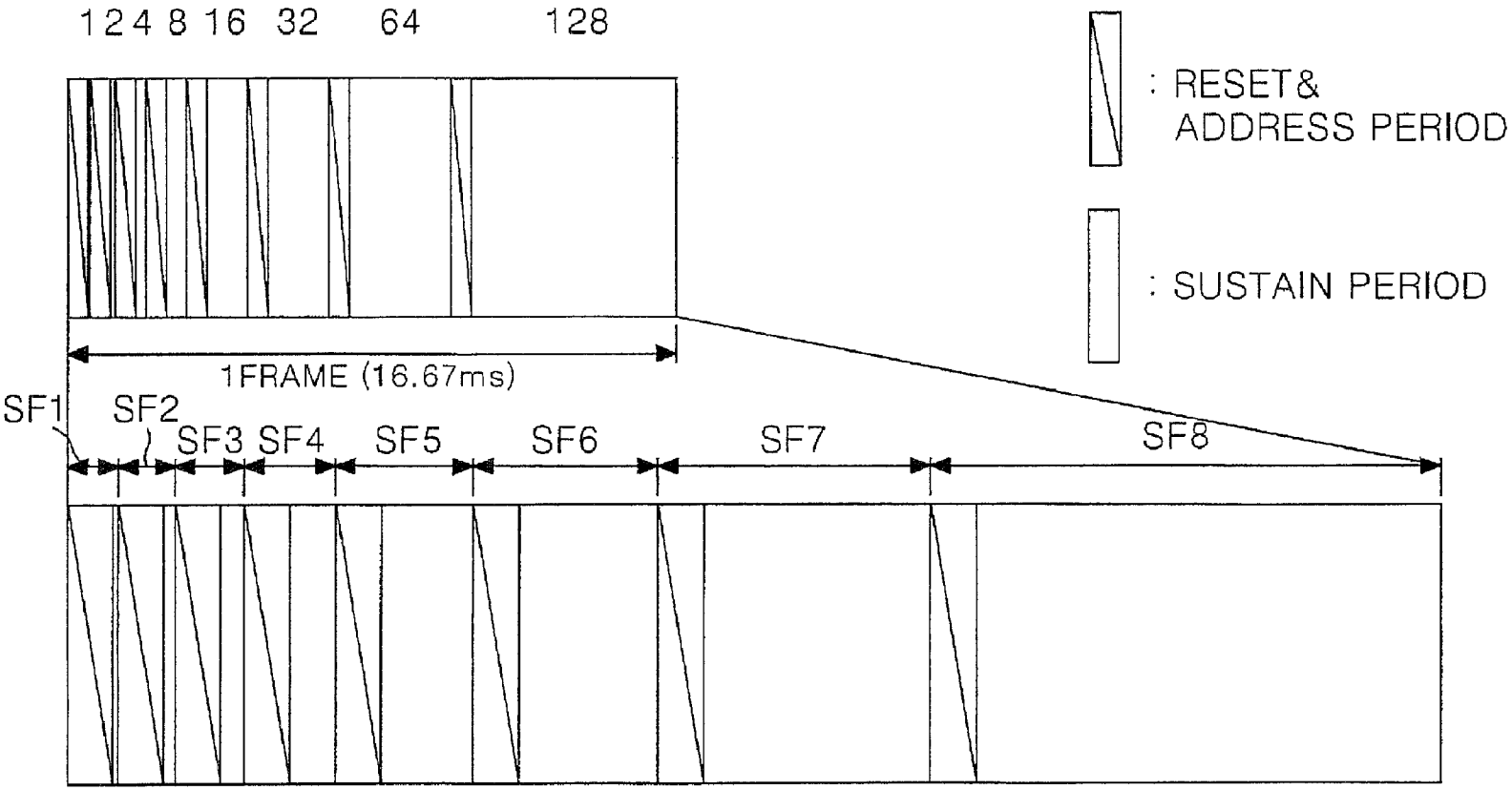
FIG. 2 RELATED ART
FIG. 2 is diagram representing the subfield pattern of an 8-bit default code that implements 256 gray levels.
Figure 3:
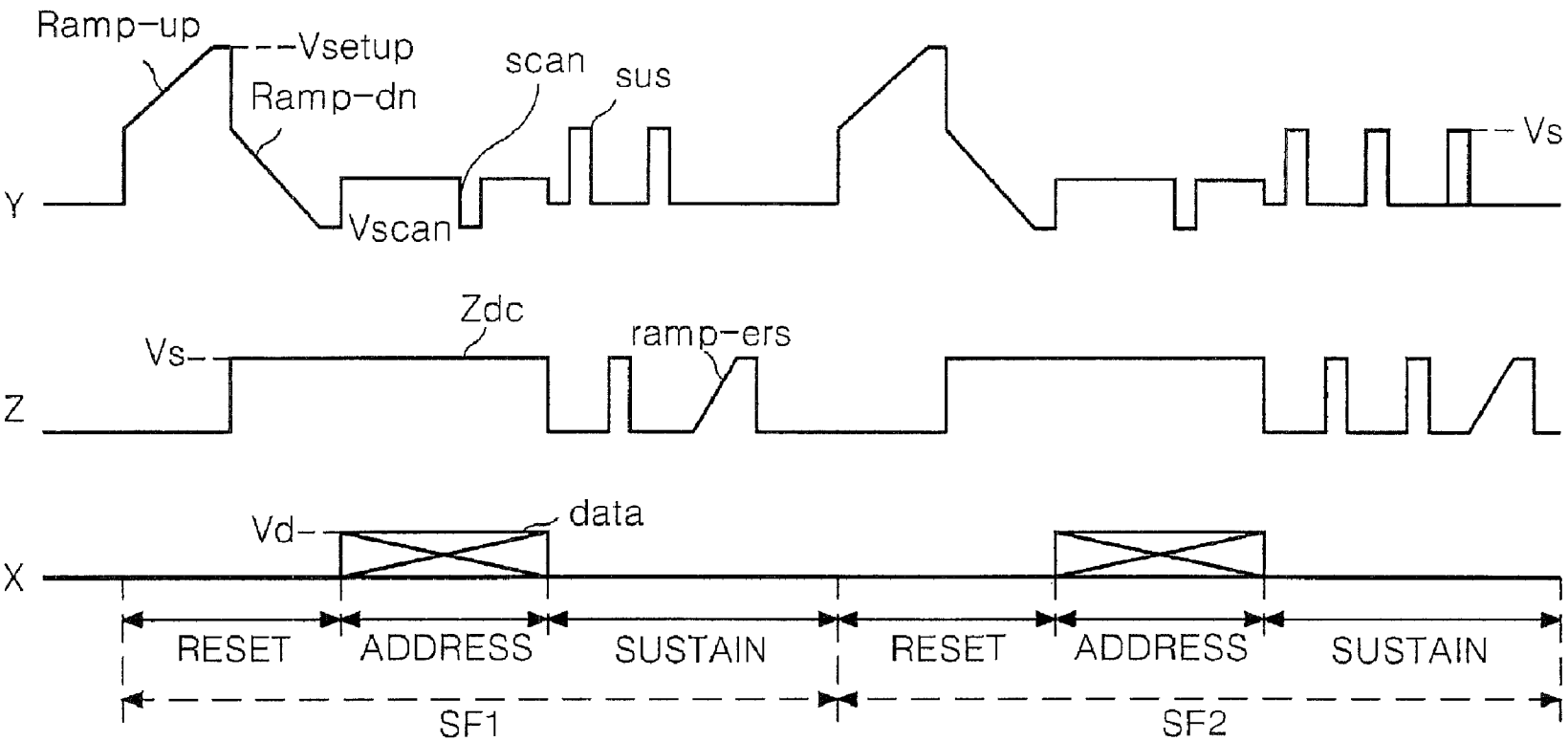
FIG. 3 RELATED ART
FIG. 3 is a waveform diagram representing the driving waveform of a general plasma display panel.
Figure 4:
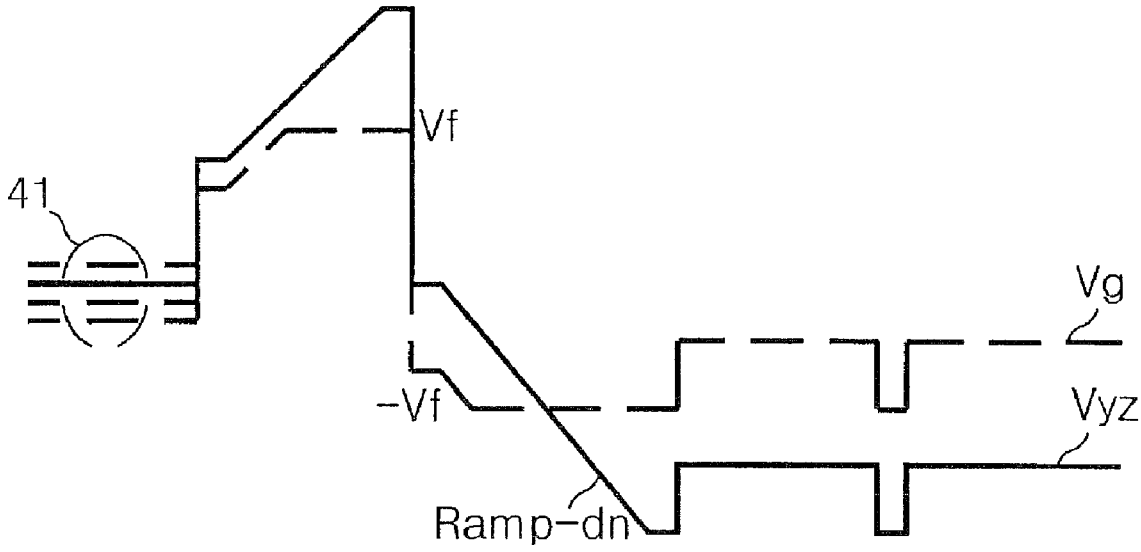
FIG. 4 RELATED ART
FIG. 4 is a waveform diagram representing the change of an external applied voltage and a gap voltage in a plasma display panel that has low Xe content.
Figure 5:
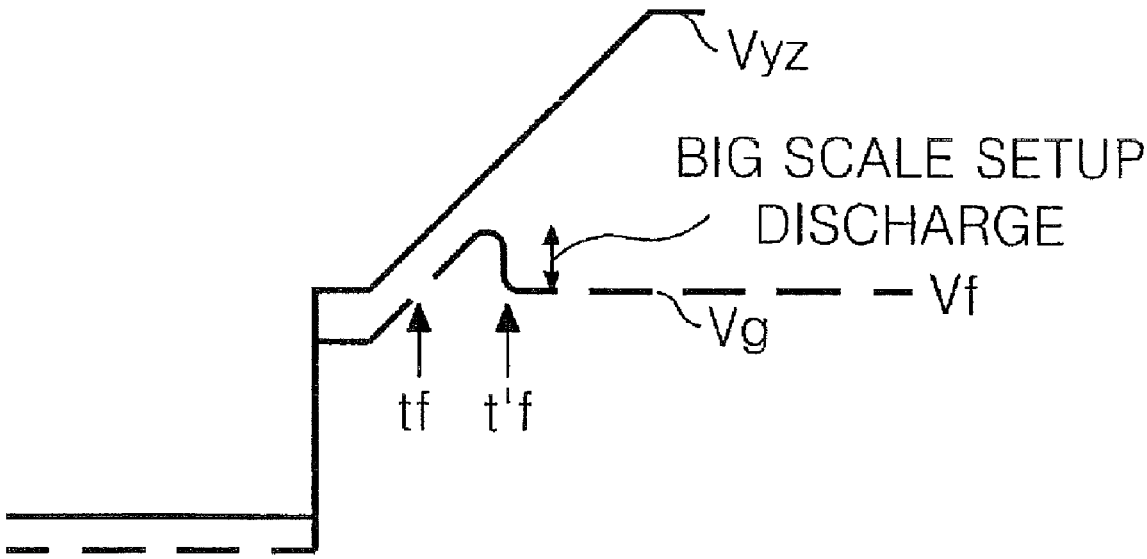
FIG. 5 RELATED ART
FIG. 5 is a waveform diagram representing the change of an external applied voltage and a gap voltage in a plasma display panel that has high Xe content.
Figure 6:
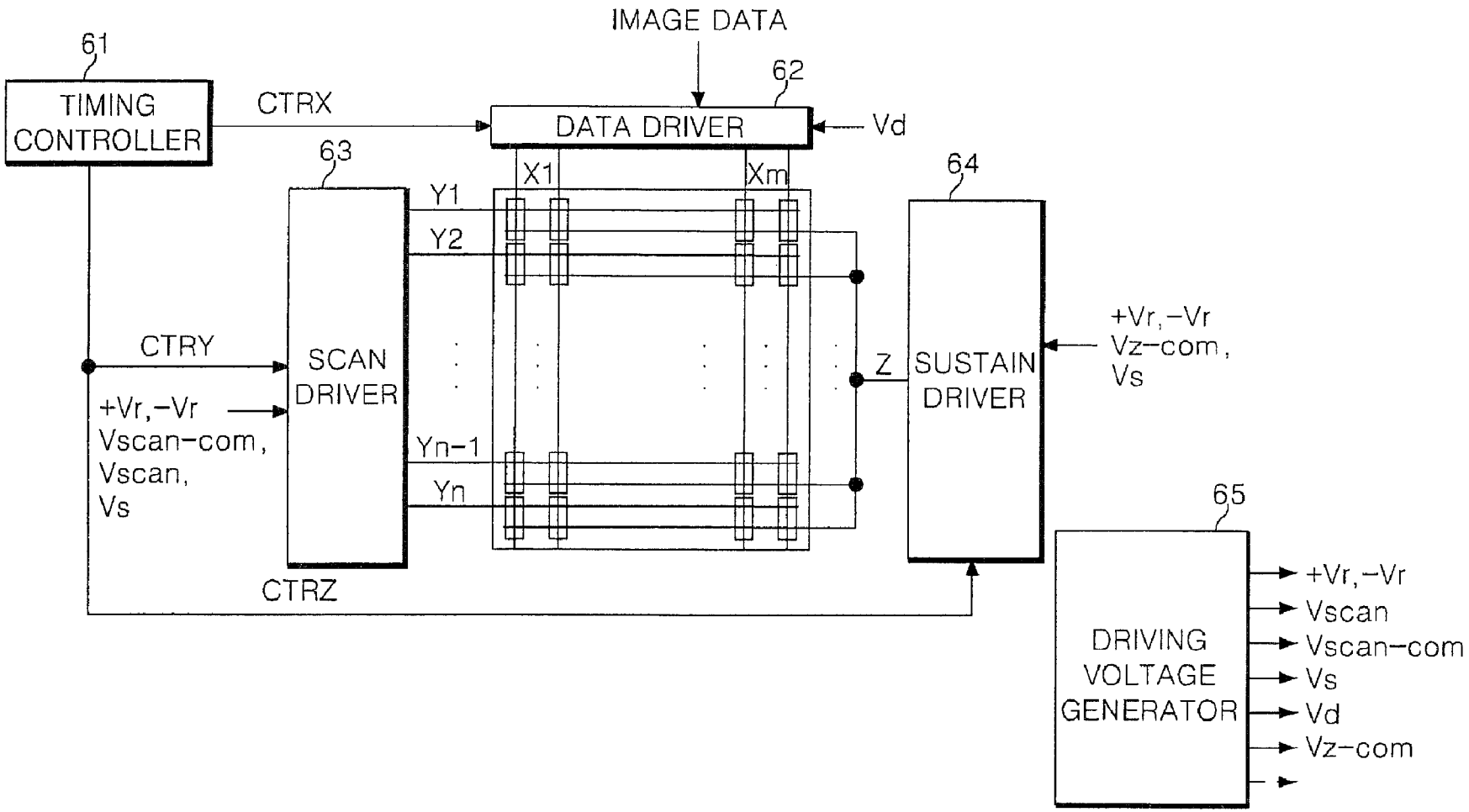
FIG. 6 is a block diagram representing a driving apparatus of a plasma display panel according to an embodiment of the present invention.

Referring to FIG. 6, a driving apparatus of a PDP according to an embodiment of the present invention includes a data driver 62 to supply data to address electrodes X1 to Xm, a scan driver 63 to drive scan electrodes Y1 to Yn, a sustain driver 64 to drive a sustain electrode Z as a common electrode, a timing controller 61 to control each of the drivers 62, 63, 64, and a driving voltage generator 65 to supply a driving voltage to each of the drivers 62, 63, 64.

The data driver 62 receives data that are mapped to the subfield patterns which are preset by a subfield mapping circuit after the data is reverse-gamma-corrected and error-diffused by a reverse gamma correction circuit and an error diffusion circuit (not shown). The data driver 62 samples and latches the data under control of the timing controller 61, and then supplies the data to the address electrodes X1 to Xm.

The scan driver 63 supplies a rising ramp waveform with low gradient that are to initialize the full screen to the scan electrodes Y1 to Yn and then supplies a falling ramp waveform to the scan electrodes Y1 to Yn for the reset period under control of the timing controller 61. Differently from this, the scan driver 63 might consecutively supply the same rising ramp waveforms to the scan electrodes Y1 to Yn twice or more and then supply the falling ramp waveform to the scan electrodes Y1 to Yn. And the scan driver 63 sequentially supplies negative scan pulses to the scan electrodes Y1 to Yn for the address period in order to select the scan line, and then supplies to the scan electrodes Y1 to Yn the sustain pulse that causes the sustain discharge to be generated at the selected cell for the sustain period.

The sustain driver 64 supplies to the sustain electrodes Z a rising ramp waveform with higher gradient than the rising ramp waveform applied to the sustain electrodes Z for the reset period under control of the timing controller 61, and then supplies the falling ramp waveform to the sustain electrodes Z. Also, the sustain driver 64 supplies a positive DC bias voltage to the sustain electrodes Z for the address period, and then, with being alternately operated with the scan driver 63, supplies the sustain pulse to the sustain electrodes Z for the sustain period.

At least one of the scan driver 63 and the sustain driver 64 supplies to the scan electrodes Y1 to Yn and/or the sustain electrodes Z the erasure signals to eliminate the wall charges left within the cell after the sustain discharge is finished.

The timing controller 61 receives vertical/horizontal synchronization signals and clock signals, generates timing control signals CTRX, CTRY, CTRZ that are necessary for the drivers 62, 63, 64, and supplies the timing control signals CTRX, CTRY, CTRZ to the corresponding drivers 62, 63, 64, thereby controlling the drivers 62, 63, 64, respectively. The timing control signal CTRX supplied to the data driver 62 includes a sampling clock to sample data, a latch control signal, a switch control signal to control the on/off time of an energy recovery circuit and a driving switch device. The timing control signal CTRY applied to the scan driver 63 includes a switch control signal to control the on/off time of an energy recovery circuit and a driving switch device within the scan driver 63. The timing control signal CTRZ applied to the sustain driver 64 includes a switch control signal to control the on/off time of an energy recovery circuit and a driving switch device within the sustain driver 64.

The driving voltage generator 65 generates a setup voltage +Vr to be set as a voltage of rising ramp waveform, a set-down voltage +Vr to be set as a voltage of falling ramp waveform, a scan bias voltage Vscan-com supplied to the scan electrode Y for the address period, a scan voltage Vscan to be set as a voltage of scan pulse, a sustain voltage Vs of sustain pulse, and a data voltage Vd. The set-down voltage −Vr might be set to be the same as the scan voltage Vscan.

In order to differentiate the gradient of the rising ramp waveform applied to the scan electrodes Y1 to Yn and the sustain electrodes Z, the scan driver 63 and the sustain driver 64 includes a variable resistance that generates a rising ramp waveform with a gradient determined in accordance with an RC time constant and is capable of adjusting the value of R in accordance with the gradient of the pre-selected ramp waveform.

Figure 7:
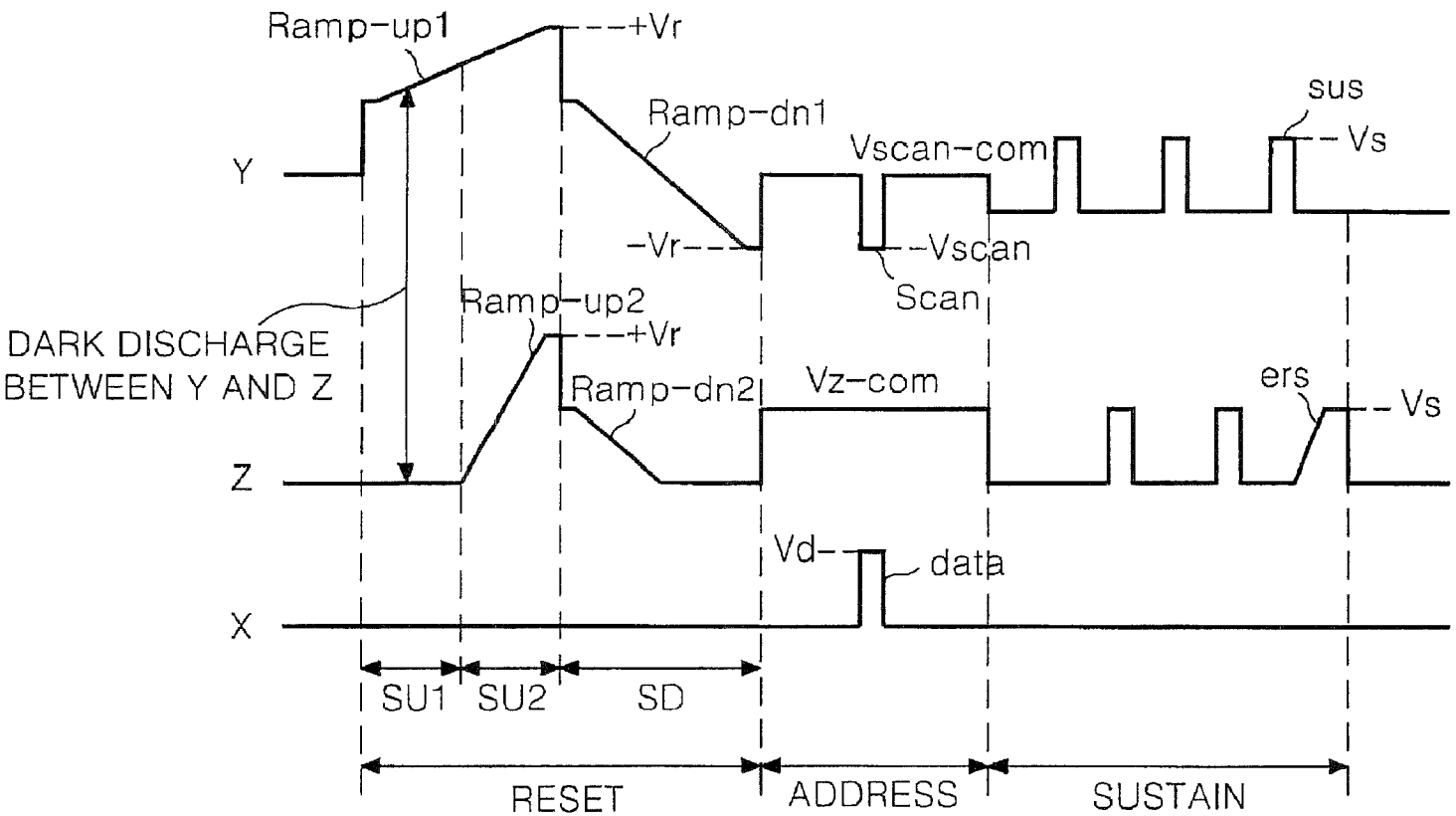
FIG. 7 is a waveform diagram to explain a driving method of a plasma display panel according to a first embodiment of the present invention.

FIG. 7 represents the driving waveform of a PDP according to a first embodiment of the present invention.

Referring to FIG. 7, a driving method of a PDP according to a first embodiment of the present invention time-dividedly drives the PDP by dividing one frame period into a reset period to initialize the cells of the PDP, an address period to select the cells, and a sustain period to sustain the discharge of the selected cells.

Figure 8:
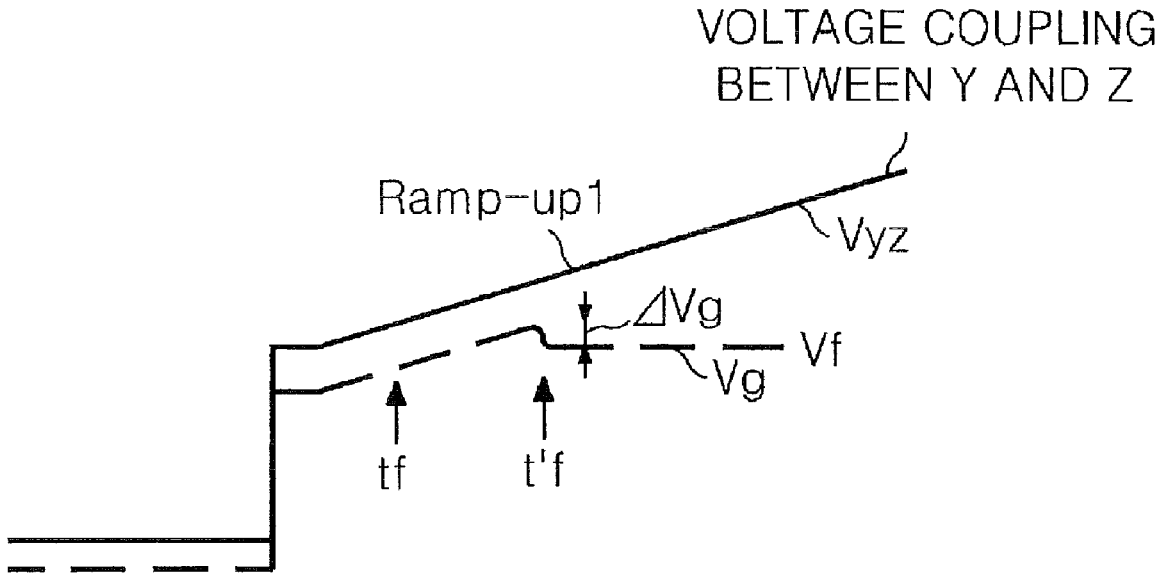
FIG. 8 is a waveform diagram to explain that the rising extent of a gap voltage is low when the gradient of a ramp waveform is low.

In a first setup period SU1 of the reset period, a first rising ramp waveform Ramp-up1 of which the voltage rises with low gradient is applied to all the scan electrodes Y. Simultaneously, 0V or ground voltage GND is applied to the sustain electrodes z and the address electrodes X. The first rising ramp waveform Ramp-up1 causes a setup discharge where almost no light is generated between the scan electrode Y and the address electrode X and between the scan electrode Y and the sustain electrode Z within the cells of the full screen. At this moment, because the gradient of the first rising ramp waveform Ramp-up1 is low, as shown in FIG. 8, even if the setup discharge is generated at the point of time tf' by discharge delay, the setup discharge is generated when the rising extent ΔVg of a gap voltage is small, thus the setup discharge is generated as a dark discharge where almost no light is generated. Therefore, excessive wall charges are not accumulated within the cell because the discharge is weakly generated as compared with the prior art where the setup discharge is generated as a ramp waveform with relatively high gradient. The setup discharge causes positive (+) wall charges to be left on the address electrode X and the sustain electrode Z, and negative (−) wall charges to be left on the scan electrode Y.

In a second setup period SU2 of the reset period, the voltage of the first rising ramp waveform Ramp-up1 continuously goes up until the voltage on all the scan electrodes Y goes up to the setup voltage +Vr. And a second rising ramp waveform Ramp-up2 is applied to the sustain electrodes Z for the second setup period SU2 of the reset period, wherein the second rising ramp waveform Ramp-up2 sharply goes up from around the sustain voltage to the setup voltage +Vr. The gradient of the second rising ramp waveform Ramp-up2 is higher than that of the first rising ramp waveform Ramp-up1. During this period, the address electrodes X remain at 0V or the ground voltage GND. A second setup discharge is generated as a dark discharge between the scan electrode Y and the address electrode X and between the sustain electrode Z and the address electrode X during the second setup period SU2 of the reset period because almost no voltage difference is generated between the scan electrodes Y and the sustain electrodes Z as the second rising ramp waveform Ramp-up2 is supplied to the sustain electrodes Y. Then, the positive wall charges on the address electrode X and the negative wall charges on the scan electrode Y are increased, and the wall charges on the sustain electrode Z are inverted to negative polarity.

On the other hand, during the second setup period SU2, wall charges are accumulated within the cell by the discharge which is an opposite discharge, i.e., an opposite discharge between the scan electrode Y and the address electrode X and an opposite discharge between the sustain electrode Z and the address electrode X. When comparing this with the prior art, in the prior art, wall charges are accumulated within the cell mainly by a surface discharge between the scan electrode Y and the sustain electrode Z for the setup period. Compared to this, the present invention accumulates the wall charges within the cell by the opposite discharge between the electrodes Y and X or Z and X that face each other perpendicularly with a discharge space therebetween for the second setup period SU2. The opposite discharge is generated between the electrodes that face each other perpendicularly, thus the wall charges are accumulated in a relatively wider electrode area. Compared to this, the surface discharge is generated between adjacent electrodes on the same plane, thus the wall charges are mainly accumulated concentratively on one side of each electrode on which the discharge is focused. Accordingly, the second setup discharge of the present invention might accumulate the wall charges more stably and forms space charges within the cell sufficiently as compared to the prior art, thus priming effect can be made in a bigger scale.

In the latter set-down period SD of the reset period, a first falling ramp waveform Ramp-dn1 that falls from around a sustain voltage Vs to the set-down voltage −Vr is applied to the scan electrodes Y, and at the same time, a second falling ramp waveform Ramp-dn2 that falls from around the sustain voltage Vs to 0V or the ground voltage GND is applied to the sustain electrodes Z. The gradient of the first falling ramp waveform Ramp-dn1 is higher than that of the second falling ramp waveform Ramp-dn2. During this period, the address electrodes X remain at 0V or the ground voltage GND. When the falling ramp waveform Ramp-dn is applied in this way, a set-down discharge is generated between the scan electrode Y and the sustain electrode Z, wherein almost no light is generated in the set-down discharge. After the set-down discharge is generated, positive wall charges remain on the address electrodes X and negative wall charges remain on the scan electrodes Y and the sustain electrodes Z. The set-down discharge eliminates excessive wall charges that are unnecessary for the address discharge. The second falling ramp waveform Ramp-dn2 has its ending voltage set to be 0V or the ground voltage GND and is higher in absolute value than the first falling ramp waveform Ramp-dn1. Accordingly, the voltage difference between the sustain electrode Z and the address electrode X is lower than that between the scan electrode Y and the address electrode X, thus the set-down discharge between the sustain electrode Z and the address electrode X is generated in a smaller scale than the set-down discharge between the scan electrode Y and the address electrode X. As a result, the erasure amount of negative wall charges left on the sustain electrode Z upon the set-down discharge is small and the negative wall charges remain on the sustain electrode Z before the sustain discharge is initiated, thus the sustain discharge can be generated easily.

In the address period, scan pulses SCAN of negative scan voltage Vscan are sequentially applied to the scan electrodes Y and at the same time data pulses DATA of positive data voltage Vd synchronized with the scan pulses SCAN are applied to the address electrodes X. During the address period, a DC bias voltage Vz-com of sustain voltage Vs is applied to the sustain electrodes Z. As the voltage difference between the scan pulse SCAN and the data pulse DATA is added to the wall voltages caused by the wall charges remaining right after the reset period, the address discharge is generated within the cell to which the data pulse DATA is applied. When sustain voltages Vs are applied, wall charges to the extent that the discharge might be generated are left within the cells selected by the address discharge.

In the sustain period, sustain pulses SUS are alternately applied to the scan electrodes Y and the sustain electrodes Z. Then, in the cells selected by the address discharge, as the wall voltage within the cell is added to the sustain pulse SUS, a sustain discharge, i.e., display discharge, is generated between the scan electrode Y and the sustain electrode Z whenever each sustain pulse SUS is applied. After completing the sustain discharge, an erasure ramp waveform ERS is applied to the sustain electrodes Z. The erasure ramp waveform ERS causes the erasure discharge within the cell to eliminate the wall charges, which remain within the cell, before the reset period.

Figure 9:
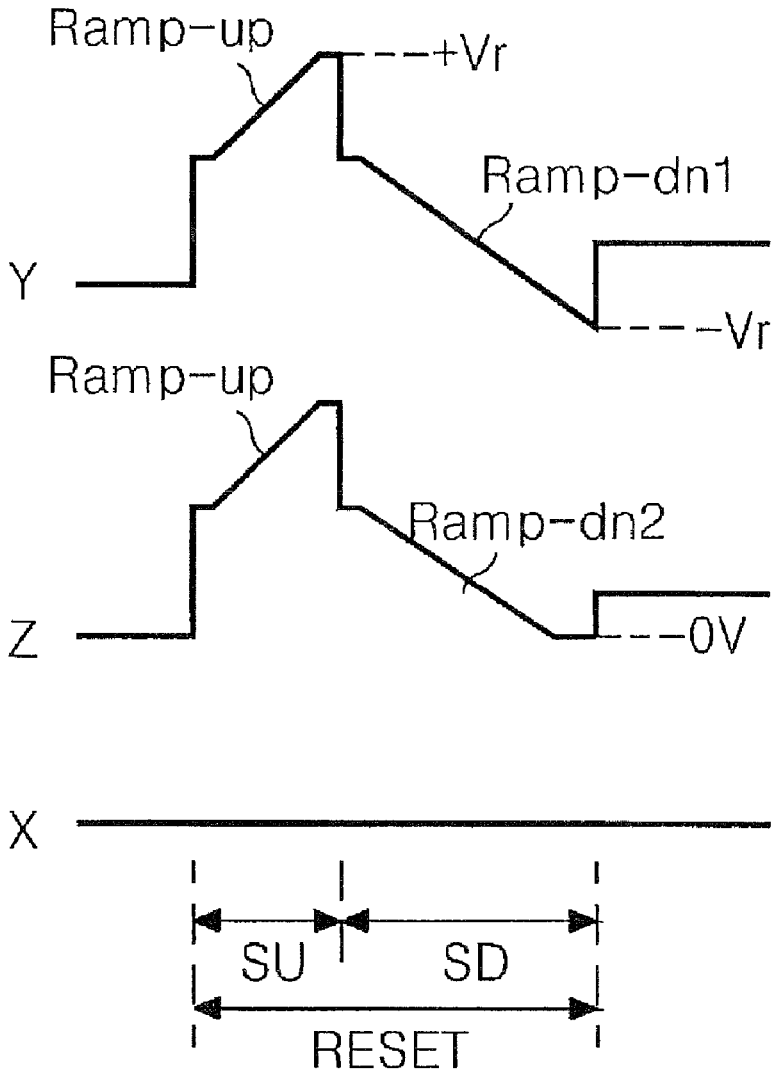
FIG. 9 is a waveform diagram representing a driving waveform of a plasma display panel that has been applied for a patent by this applicant.

On the other hand, the applicant of this invention proposed a driving method of a PDP in Korean patent application No 2003-0020864, wherein the driving method of the PDP applies the same type of initial waveforms to the scan electrode Y and the sustain electrode Z for the reset period, as shown in FIG. 9. The driving method of the PDP might cause the setup discharge or the set-down discharge to not be generated between the scan electrode Y and the sustain electrode Z and to be generated between the scan electrode Y and the address electrode X and between the sustain electrode Z and the address electrode X, by simultaneously applying the rising ramp waveform and the falling ramp waveform to the scan electrode Y and the sustain electrode Z for the reset period. Due to this, almost no light is discharged by the surface discharge between the scan electrode Y and the sustain electrode Z upon the setup discharge and the set-down discharge, thus its contrast is improved and the wall charge distribution between the scan electrode Y and the address electrode X might be formed favorable to the address discharge.

Figure 10:
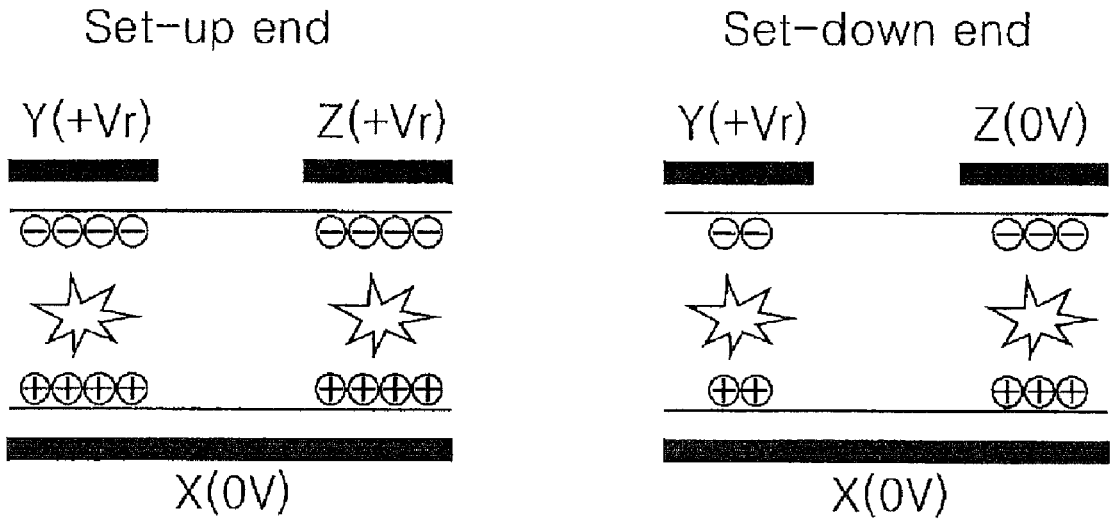
FIG. 10 is a diagram representing the change of wall charge distribution of a reset period when the waveform of FIG. 9 is applied to the plasma display panel.

FIG. 10 briefly represents the wall charge distribution right after the setup discharge and the set-down discharge in the pre-applied driving method and apparatus of the plasma display panel.

According to the pre-applied driving method of the PDP, because no setup discharge is generated between the scan electrode Y and the sustain electrode Z, the initialization is more or less unstable and the discharge delay might be generated upon the setup discharge and the set-down discharge if the content of Xe is high in the discharge gas.

Figure 11:
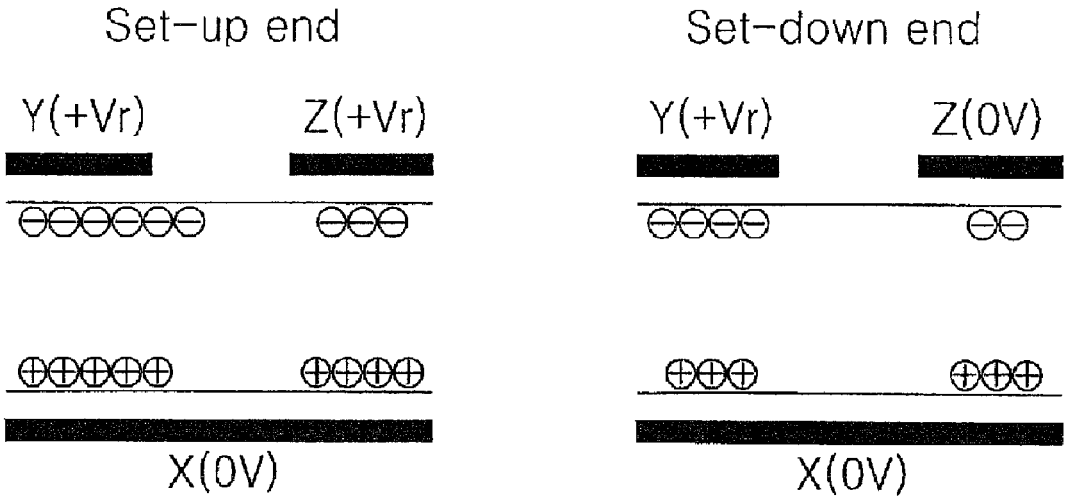
FIG. 11 is a diagram representing the change of wall charge distribution of a reset period when the waveform of FIG. 7 is applied to the plasma display panel.

Compared to this, the present invention generates a first setup discharge between the scan electrode Y and the sustain electrode Z for the first setup period, and a second setup discharge between the scan electrode Y and the address electrode X and between the sustain electrode Z and the address electrode X for the second setup period, thus the wall charges are sufficiently accumulated between the scan electrode Y and the address electrode X, as shown in FIG. 11.

FIG. 11 briefly represents the wall charge distribution within the cell right after the setup discharge and the set-down discharge when the driving waveform shown in FIG. 7 is applied to the PDP.

As shown in the comparison of FIGS. 10 and 11, the driving method and apparatus of the PDP according to the embodiment of the present invention, compared to the pre-applied method, accumulates more wall charges between the scan electrode Y and the address electrode X, thus the address driving margin is increased and the discharge delay is reduced upon the address discharge, thereby enabling the PDP to be driven at high speed.

The driving method and apparatus of the PDP according to the embodiment of the present invention lowers the gradient of the first rising ramp waveform Ramp-up1 that is applied to the scan electrode Y, thus the rising extent of the gap voltage Vg of when the setup discharge is generated is small even though the discharge is delayed when the content of Xe is high in the discharge gas, thereby not generating the setup discharge in a big scale.

Figure 12:
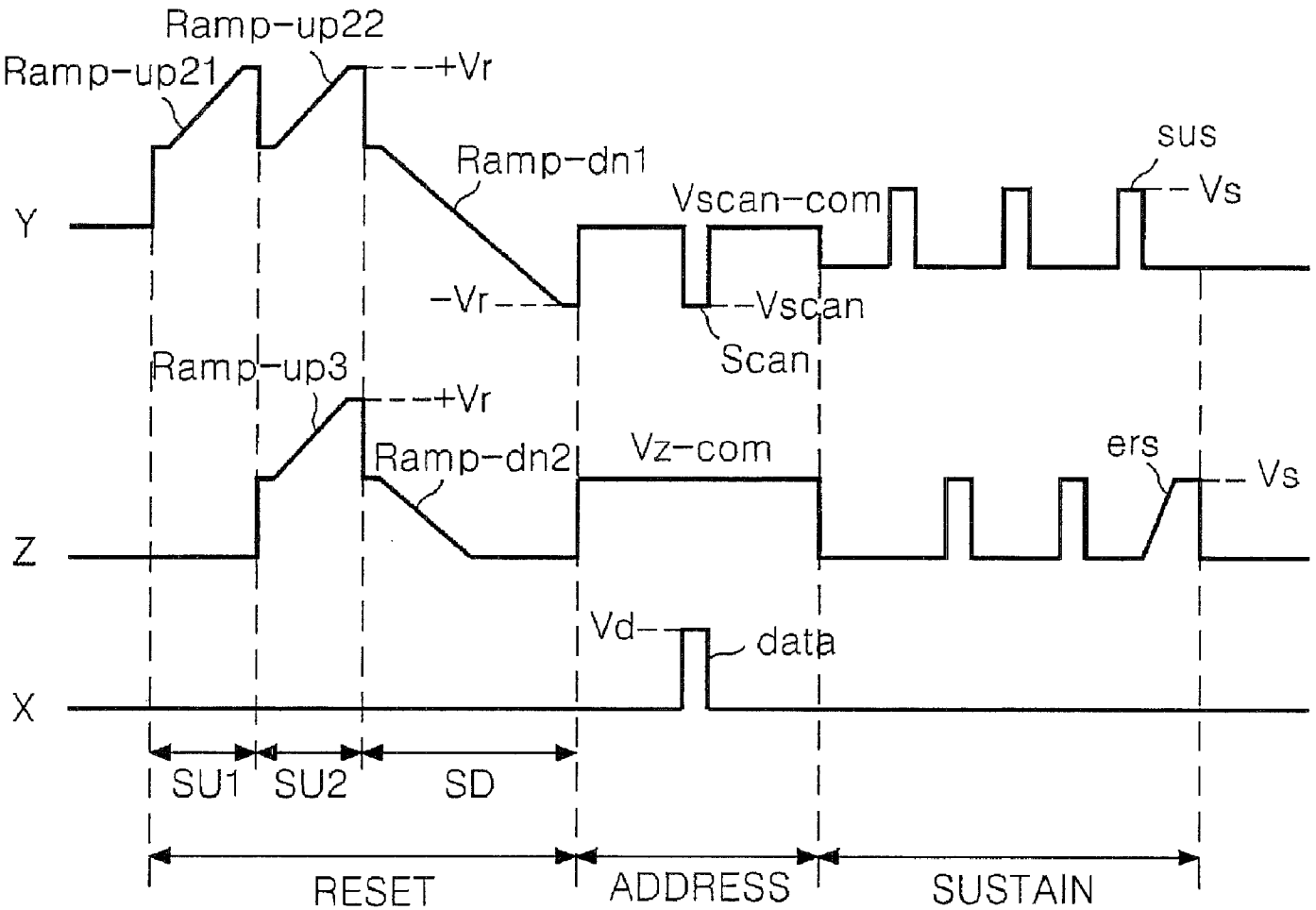
FIG. 12 is a waveform diagram to explain a driving method of a plasma display panel according to a second embodiment of the present invention.

FIG. 12 represents a driving waveform of a PDP according to a second embodiment of the present invention.

Referring to FIG. 12, the driving method of the PDP according to the second embodiment of the present invention consecutively supplies the same rising ramp waveform Ramp-up21, Ramp-up22 to the scan electrodes Y for the reset period to accumulate the sufficient amount of the wall charges of positive polarity on the address electrodes X, thereby reducing the discharge delay.

In a first setup period SU1 of the reset period, a first rising ramp waveform Ramp-up21 that rises to the setup voltage +Vr is applied to all the scan electrodes Y. Simultaneously, 0V or ground voltage GND is applied to the sustain electrodes Z and the address electrodes X. The first rising ramp waveform Ramp-up21 causes a setup discharge where almost no light is generated between the scan electrode Y and the address electrode X and between the scan electrode Y and the sustain electrode Z within the cells of the full screen. The setup discharge causes positive (+) wall charges to be left on the address electrode X and the sustain electrode Z, and negative (−) wall charges to be left on the scan electrode Y. The setup discharge causes the sufficient amount of the wall charges of positive polarity to be accumulated on the address electrode X.

In a second setup period SU2 of the reset period, after the voltage on all the scan electrodes Y is kept at the sustain voltage for a designated time period, the second rising ramp waveform Ramp-up22 that goes up to the setup voltage +Vr is applied to the scan electrodes Y. And for the second setup period SU2 of the reset period, a third rising ramp waveform Ramp-up3 that goes up to the setup voltage +Vr is applied to the sustain electrodes Z. The first to third ramp waveforms Ramp-up21, Ramp-up22, Ramp-up3, as shown in FIG. 12, might have their beginning voltage, ending voltage and ramp rate (or gradient) set equally, and have at least one of them set differently. During the period, the address electrodes X remain at 0V or the ground voltage GND. A second setup discharge is generated as a dark discharge between the scan electrode Y and the address electrode X and between the sustain electrode Z and the address electrode X during the second setup period SU2 of the reset period because the second rising ramp waveform Ramp-up22 and the third rising ramp waveform Ramp-up1 causes almost no voltage difference to be generated between the scan electrodes Y and the sustain electrodes Z. Then, the positive wall charges on the address electrode X and the negative wall charges on the scan electrode Y are increased, and the wall charges on the sustain electrode Z are inverted to negative polarity.

In the latter set-down period SD of the reset period, a first falling ramp waveform Ramp-dn1 that falls from around a sustain voltage Vs to the set-down voltage −Vr is applied to the scan electrodes Y, and at the same time, a second falling ramp waveform Ramp-dn2 that falls from around the sustain voltage Vs to 0V or the ground voltage GND is applied to the sustain electrodes Z. For the set-down period SD, the address electrodes X remain at 0V or the ground voltage GND. When the falling ramp waveform Ramp-dn is applied in this way, a set-down discharge is generated between the scan electrode Y and the sustain electrode Z, wherein almost no light is generated in the set-down discharge. After the set-down discharge is generated, positive wall charges remain on the address electrodes X and negative wall charges remain on the scan electrodes Y and the sustain electrodes Z. The set-down discharge eliminates excessive wall charges that are unnecessary for the address discharge. The second falling ramp waveform Ramp-dn2 has its ending voltage set to be 0V or the ground voltage GND and higher in absolute value than the ending voltage of the first falling ramp waveform Ramp-dn1 of negative voltage. Accordingly, the voltage difference between the sustain electrode Z and the address electrode X is lower than that between the scan electrode Y and the address electrode X, thus the set-down discharge between the sustain electrode z and the address electrode X is generated in a smaller scale than the set-down discharge between the scan electrode Y and the address electrode X. As a result, the erasure amount of negative wall charges left on the sustain electrode Z upon the set-down discharge is small and the negative wall charges remain on the sustain electrode Z before the sustain discharge is initiated, thus the sustain discharge can be generated easily.

Because virtually the same driving waveform as the driving waveform shown in FIG. 7 is generated in the address period and the sustain period, detail description thereto is to be omitted.

Figure 13:
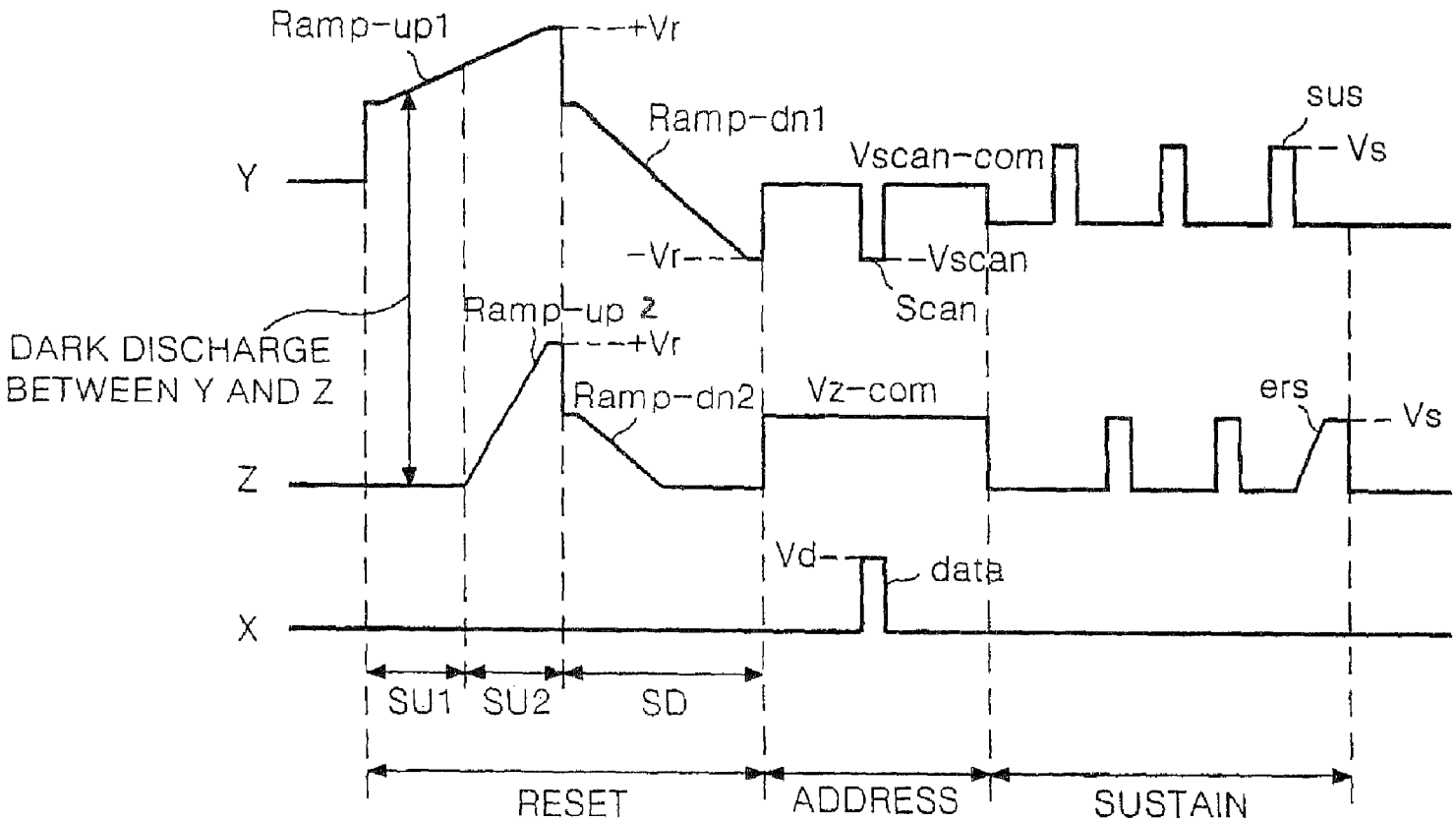
FIG. 13 is a waveform diagram to explain a driving method of a plasma display panel according to a third embodiment of the present invention.

FIG. 13 represents a driving waveform of a PDP according to a third embodiment of the present invention.

Referring to FIG. 13, in a first setup period SU1 of the reset period, a first rising ramp waveform Ramp-up1 of which the voltage rises with low gradient is applied to all the scan electrodes Y. Simultaneously, 0V or ground voltage GND is applied to the sustain electrodes Z and the address electrodes X. The first rising ramp waveform Ramp-up1 causes a setup discharge where almost no light is generated between the scan electrode Y and the address electrode X and between the scan electrode Y and the sustain electrode Z within the cells of the full screen. The setup discharge causes positive (+) wall charges to be left on the address electrode X and the sustain electrode Z, and negative (−) wall charges to be left on the scan electrode Y.

In a second setup period SU2 of the reset period, the voltage of the first rising ramp waveform Ramp-up1 continuously goes up until the voltage on all the scan electrodes Y goes up to the setup voltage +Vr. And a second rising ramp waveform Ramp-up2 is applied to the sustain electrodes Z for the second setup period SU2 of the reset period, wherein the second rising ramp waveform Ramp-up2 goes up from 0V or the ground voltage GND to the setup voltage +Vr. The gradient of the second rising ramp waveform Ramp-up2 is higher than that of the first rising ramp waveform Ramp-up1. During this period, the address electrodes X remain at 0V or the ground voltage GND. A second setup discharge is generated as a dark discharge between the scan electrode Y and the address electrode X and between the sustain electrode Z and the address electrode X during the second setup period SU2 of the reset period because almost no voltage difference is generated between the scan electrodes Y and the sustain electrodes Z as the second rising ramp waveform Ramp-up2 is supplied to the sustain electrodes Y. Then, the positive wall charges on the address electrode X and the negative wall charges on the scan electrode Y are increased, and the wall charges on the sustain electrode Z are inverted to negative polarity.

As shown in the comparison of FIGS. 7 and 13, in the driving method of the PDP according to the third embodiment of the present invention, as in FIG. 7, the voltage on the sustain electrodes Z does not sharply go up from the sustain voltage Vs but gently rises from 0V or the ground voltage GND to the setup voltage +Vr when the second rising ramp waveform Ramp-up 2 is supplied. Accordingly, the driving method of the PDP according to the third embodiment of the present invention might prevent the fact that the voltage on the scan electrodes Y is instantaneously changed by a voltage coupling between the sustain electrodes Z and the scan electrodes Y when the second rising ramp waveform Ramp-up 2 is supplied to the sustain electrodes Z.

In this embodiment, the set-down period, the address period and the sustain period are virtually the same as the foregoing embodiments, thus the detail description thereto is to be omitted.

As described above, the driving method and apparatus of the PDP according to the present invention applies the rising ramp waveform with low gradient to the scan electrode for the reset period, and the rising ramp waveform with high gradient to the sustain electrode facing the scan electrode in a plane direction while the voltage on the scan electrode rises. Also, the driving method and apparatus of the PDP according to the present invention continuously generates the setup discharge twice by continuously applying the same rising ramp waveform twice to the scan electrode for the reset period and applying the rising ramp waveform to the sustain electrode facing the scan electrode in a plane direction while the second rising ramp waveform is applied to the scan electrode. As a result, the driving method and apparatus of the PDP according to the present invention generates the setup discharge as the dark discharge that almost no light is generated for the reset period, thus even if the content of Xe is high in the discharge gas, its contrast is improved and sufficient positive wall charges are accumulated on the address electrode, thereby enabling the PDP to be driven at a high speed.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method for driving a display device based on a frame of data, said frame divided into a reset period, an address period, and a sustain period, the method comprising:

applying a first rising waveform to a scan electrode during a first set-up period of the reset period, the first rising waveform applied to the scan electrode while a ground voltage is applied to the sustain electrode;

applying a third rising waveform to the scan electrode during a second set-up period of the reset period, the third rising waveform applied to the scan electrode while a fourth rising waveform different from the ground voltage is applied to the sustain electrode; and generating a set-down discharge between the scan and sustain electrodes during a set-down period of the reset period, wherein the third and fourth rising waveforms rise to substantially a same maximum voltage.

2. The method of claim 1, wherein the first rising waveform and the third rising waveform have substantially a same gradient.

3. The method of claim 2, wherein the third rising waveform rises to a higher maximum voltage than the first rising waveform.

4. The method of claim 3, wherein the first and third rising waveforms increase in voltage throughout the first and second set-up periods.

5. The method of claim 1, wherein the third rising waveform has a lower gradient than the fourth rising waveform.

6. The method of claim 1, wherein generating the set-down discharge includes:

applying a fifth waveform to the scan electrode during the set-down period; and applying a sixth waveform to the sustain electrode during the set-down period, wherein the fifth and sixth waveforms have different gradients.

7. The method of claim 6, wherein the gradient of the sixth waveform is higher than the gradient of the fifth waveform.

8. A method for driving a display device based on a frame of data, said frame divided into a reset period, an address period, and a sustain period, the method comprising:

applying a first rising waveform to a scan electrode during a first set-up period of the reset period, the first waveform applied to the scan electrode while a ground voltage is applied to the sustain electrode;

applying a third rising waveform to the scan electrode during a second set-up period of the reset period, the third rising waveform applied to the scan electrode while a fourth rising waveform is applied to the sustain electrode; and generating a set-down discharge between the scan and sustain electrodes during a set-down period of the reset period, wherein the first, third, and fourth rising waveforms have substantially a same gradient and wherein the third and fourth rising waveforms rise to substantially a same maximum voltage.

9. The method of claim 8, wherein the first, third, and fourth rising waveforms rise to substantially a same voltage.

10. The method of claim 8, wherein the first and third rising waveforms have substantially a same beginning voltage and substantially a same ending voltage within the first and second set-up periods.

11. The method of claim 8, wherein generating the set-down discharge includes:

applying a fifth waveform to the scan electrode during the set-down period; and applying a sixth waveform to the sustain electrode during the set-down period, wherein the fifth and sixth waveforms are different waveforms.

12. A method for driving a display device based on a frame having a plurality of sub-fields, at least one sub-fields having a prescribed duration, the method comprising:

applying a first waveform to a scan electrode during a first period of said prescribed duration;

applying a second waveform to a sustain electrode during the first period;

applying a third waveform to the scan electrode during a second period of said prescribed duration; and applying a fourth waveform to the sustain electrode during the second period, wherein the first and second waveforms are ramp-up waveforms and the third and forth waveforms are ramp-down waveforms, wherein the fourth waveform ramps down to a voltage level different from the third waveform, and wherein the first and second waveforms increase to substantially a same voltage level.

13. The method of claim 12, wherein the first and second waveforms increase at substantially a same rate.

14. The method of claim 12, wherein the third and fourth waveforms decrease at different rates.

15. The method of claim 12, wherein the third waveform ramps down to a lower voltage level than the fourth waveform.

16. The method of claim 12, wherein the second period is after the first period.

17. The method of claim 12, further comprising:

applying alternating pulses to the scan and sustain electrodes during a third period of said prescribed duration, wherein the third period is after the first and second periods.

18. The method of claim 17, further comprising:

applying a data pulse to a data electrode between the second and third periods, wherein a peak voltage level of the data pulse is a positive data voltage.

19. A method for controlling a display device based on a frame having a plurality of sub-fields, at least one sub-field having a prescribed duration, the method comprising:

applying a first rising waveform to a scan electrode during a first period of said prescribed duration;

applying a second rising waveform to a sustain electrode during the first period;

applying a third falling waveform to the scan electrode during a second period of said prescribed duration; and applying a fourth falling waveform to the sustain electrode during the second period, wherein the first and second rising waveforms are ramp-up waveforms and the third and fourth falling waveforms are ramp-down waveforms, wherein the first rising waveform begins to ramp up before the second rising waveform, and wherein the first and second rising waveforms increase to substantially a same voltage level.

20. The method of claim 19, wherein a gradient of the second rising waveform is greater than a gradient of the first rising waveform.

21. The method of claim 19, wherein the third and fourth falling waveforms decrease to different voltage levels.

22. The method of claim 21, wherein the third falling waveform decreases to a voltage level lower than the fourth falling waveform.

23. The method of claim 19, wherein the second period is after the first period.

24. The method of claim 19, further comprising:

applying alternating pulses to the scan and sustain electrodes during a third period of said prescribed duration, wherein the third period is after the first and second periods.

25. The method of claim 24, further comprising:

applying a data pulse to a data electrode between the second and third periods, wherein a peak voltage level of the data pulse is a positive data voltage.

* * * * *